United States Patent [19]

Cuhel

[11] 4,020,587

[45] May 3, 1977

[54] TOY VEHICLE PLOW MOUNTING

[75] Inventor: Gerald A. Cuhel, Silver Lake, Minn.

[73] Assignee: Tonka Corporation, Hopkins, Minn.

[22] Filed: Feb. 4, 1976

[21] Appl. No.: 655,099

[52] U.S. Cl. ..... 46/202; 46/221

[51] Int. Cl.[2] ..... A63H 17/05

[58] Field of Search ..... 46/40, 201, 202, 221

[56] References Cited

UNITED STATES PATENTS

| | | | |
|---|---|---|---|
| 2,586,239 | 2/1952 | MacKenzie | 46/219 |
| 3,462,874 | 8/1969 | Pauly et al. | 46/40 |

FOREIGN PATENTS OR APPLICATIONS

| | | | |
|---|---|---|---|
| 1,277,726 | 9/1968 | Germany | 46/219 |

*Primary Examiner*—Louis G. Mancene
*Assistant Examiner*—Robert F. Cutting

[57] ABSTRACT

A plow for a miniature toy vehicle having a front wheel axle wherein a plow blade extending transversely across the front of the vehicle is fixed to a bracket which extends rearwardly under the vehicle. The bracket has a pair of side plates each of which has a slot receiving the front wheel axle and the slots have vertically spaced notches for adjustment of the plates and the plow blade between upper and lower positions with spring means connecting the axle to the bracket to yieldably retain the bracket in either selected adjusted position.

3 Claims, 3 Drawing Figures

TOY VEHICLE PLOW MOUNTING

In the manufacture of miniature toy vehicles it is common to provide sufficient mechanism to allow the child playing with the toy some degree of choice to use the toy in different operating conditions. For example, in a toy vehicle which carries a plow blade for use in moving sand or the like, it is desirable that the blade be adjustable on the vehicle between operating and transport positions.

It is also important that the mechanism involved be durable and producible at a relatively low manufacturing cost.

It is an object of the present invention to provide a plow blade mounting for a miniature toy vehicle which permits vertical adjustment of the blade between transport and operating positions and with means for releasably locking the blade in each position.

With this and other objects in view the invention broadly comprises mounting a plow blade on a wheeled vehicle to extend across the front thereof with the blade being carried at the front end of a bracket which extends rearwardly under the vehicle and between the front wheels thereof. The front wheel axle extends through openings in the bracket which have vertically spaced notches to adjust the bracket and the blade between various selective positions and spring means act between the vehicle and bracket to yieldably retain the bracket in the selected position.

DESCRIPTION OF THE PREFERRED EMBODIMENT

Figure 1:
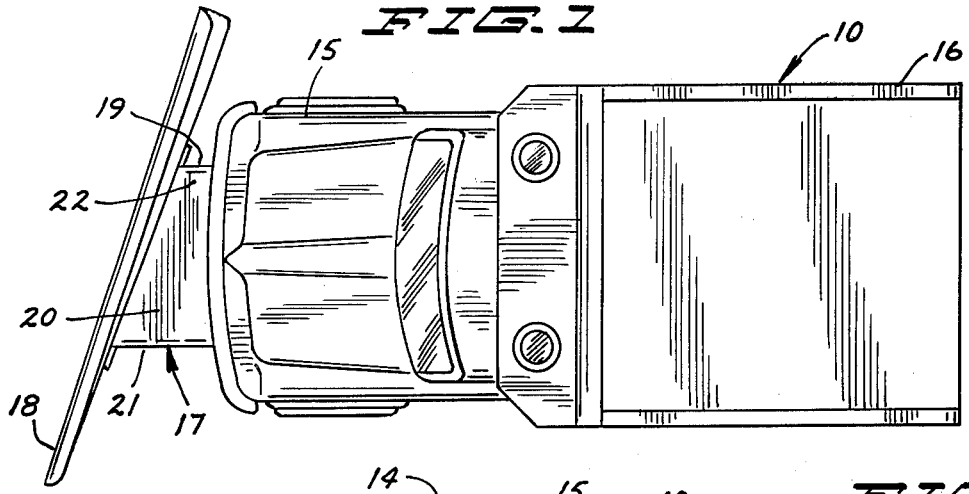
FIG. 1 is a plan view of a miniature toy vehicle with the plow mounted to extend across the front thereof.
Figure 2:
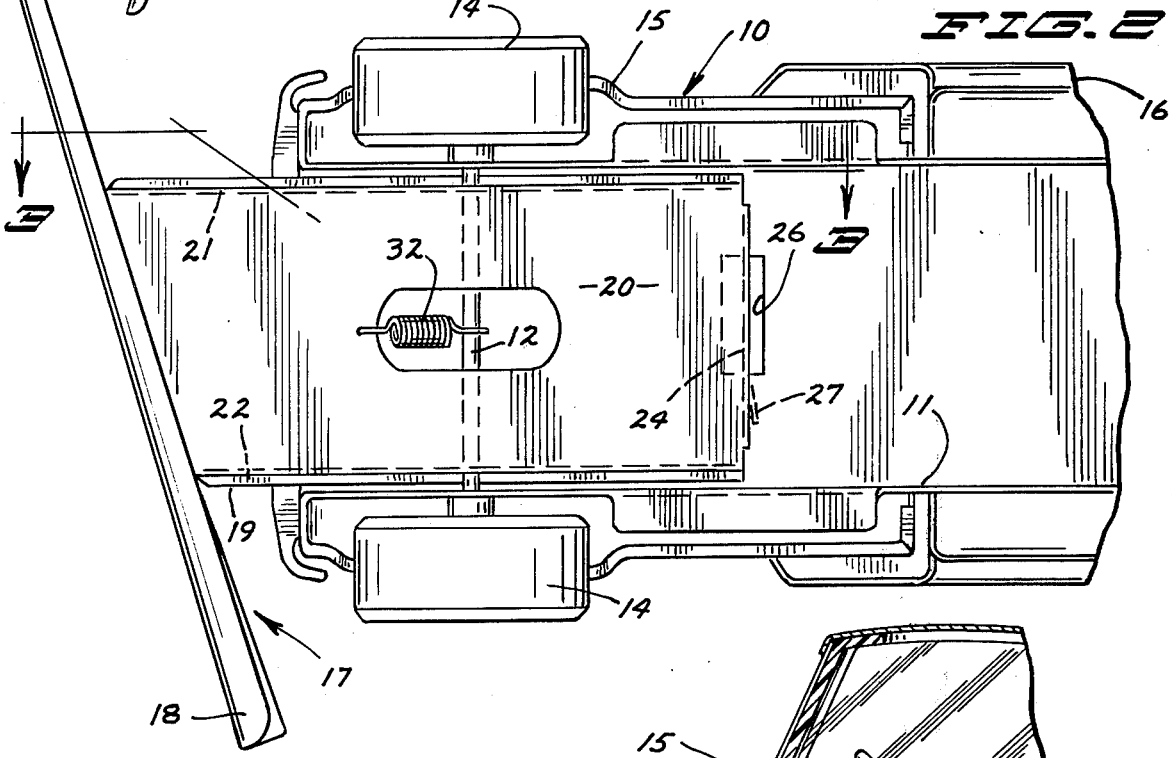
FIG. 2 is an enlarged bottom plan view of the front portion of the toy vehicle showing the plow mounting.

Referring now more particularly to the drawing reference numerals will be used to denote like parts or structural features in the different views. A miniature toy vehicle 10 has a chassis 11 supported on a front axle 12 carrying ground wheels 14 and a similar rear wheel and axle assembly, which is not shown. A hood and cab structure 15 and a truck box 16 are shown mounted on the chassis 11.

The plow assembly is denoted generally at 17 and includes a plow blade 18 integrally mounted to extend crosswise across the front of a bracket 19. Bracket 19 has a broad channel shape with a bottom wall 20, a pair of parallel fore and aft extending transversely spaced side walls 21 and 22 and a rear wall 24. Wall 24 has an upwardly extending tongue 25 (FIG. 3) which projects through an opening 26 in the chassis. Tongue 25 has a tab such as 27 which projects above chassis 11 beyond the opening 26 to prohibit withdrawal of the tongue from the opening and form a loose hinge connection between the plow assembly 17 and chassis 11. Opening 26 is sufficiently large front to rear to allow fore and aft sliding movement of tongue 25 therein.

The side walls 21 and 22 of bracket 19 are provided with transversely aligned openings 29 through which the axle 12 extends. These openings are U-shaped so that each has upper and lower rearwardly opening notches such as respectively designated at 30 and 31 and these notches are adapted to snugly seat the axle 12. A spiral spring 32 has one end engaged around the axle 12 and its forward end connected to wall 20 to bias bracket 19 in a rearward direction.

Figure 3:
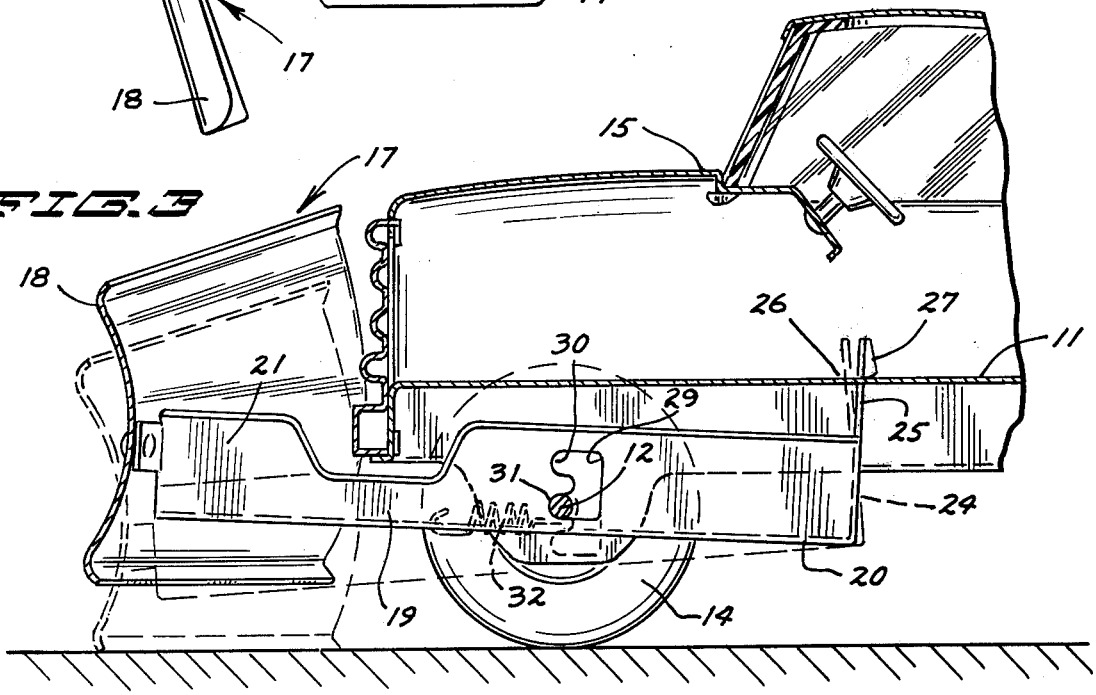
FIG. 3 is a longitudinal vertical section taken on line 3—3 of FIG. 2 with the plow in raised position but shown in lowered or operative position in broken lines.

The lower notch 31 is positioned so that when it is in engagement with the axle 12 the plow blade 18 is in raised or inoperative position as shown in full lines in FIG. 3. The upper notch 30 is positioned so that when it is in engagement with the axle the blade 18 will be in lowered operating position as shown in broken lines in FIG. 3 with the bottom edge of the blade disposed approximately on the common plane of the bottom surfaces of the front and rear ground wheels of vehicle 10.

In order to adjust the plow blade 18 between its raised and lowered positions the user of the toy holds the vehicle such as by grabbing the cab structure 15 with one hand and pulling blade 18 forwardly against the tension of spring 32 with the other hand. When the plow assembly has been pulled forwardly relative to vehicle 10 it can then be adjusted to the desired raised or lowered position and released for locking engagement between the axle 12 and the notches 30 or 31. Spring 32, of course, biases the entire assembly 17 rearwardly to retain the plow blade 18 in either raised or lowered position.

It may be desirable to provide additional vertically spaced notches such as 30 and 31 to allow adjustment of the blade 18 to other positions of elevation. While the invention is shown as a plow, it will be understood that the invention could also be used to mount a toy bulldozer or grader blade.

Having now therefore fully illustrated and described the invention, what I claim to be new and desire to protect by United States Letters Patent is:

1. In a miniature toy vehicle having a chassis supported by a front wheel axle, a plow mounted to extend transversely across the front of the vehicle and including, a. a bracket disposed under the chassis and having a front portion extending forwardly beyond the chassis, b. the rear end of said bracket having a fore and aft sliding hinge connection to the chassis on an axis to the rear of but parallel to the front wheel axle, c. a plow blade mounted on the front portion of the bracket, d. said bracket having vertically spaced notches engageable with said front wheel axle to support the blade in different selected positions of elevation, and e. spring means acting between the chassis and bracket to yieldably retain the axle in engagement with any selected notch in the bracket.

2. The subject matter of claim 1 wherein the bracket has a pair of transversely spaced upright wall portions each of which is provided with said axle engaging notches and with said notches in the wall portions being in transverse alignment.

3. The subject matter of claim 1 wherein said notches open rearwardly and said spring means connects the bracket to the axle to bias the bracket rearwardly.

* * * * *